US010487731B2

(12) United States Patent
Sasaki et al.

(10) Patent No.: US 10,487,731 B2
(45) Date of Patent: Nov. 26, 2019

(54) INTERNAL COMBUSTION ENGINE

(71) Applicant: TOYOTA JIDOSHA KABUSHIKI KAISHA, Toyota-shi, Aichi-ken (JP)

(72) Inventors: Keisuke Sasaki, Susono (JP); Hajime Takagawa, Susono (JP); Yoichiro Goya, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/446,604

(22) Filed: Mar. 1, 2017

(65) Prior Publication Data

US 2017/0254262 A1 Sep. 7, 2017

(30) Foreign Application Priority Data

Mar. 3, 2016 (JP) ..... 2016-041002

(51) Int. Cl.
*F02B 77/08* (2006.01)

(52) U.S. Cl.
CPC ..... *F02B 77/085* (2013.01)

(58) Field of Classification Search
CPC ..... F02B 77/085
See application file for complete search history.

(56) References Cited

U.S. PATENT DOCUMENTS

2002/0157629 A1* 10/2002 Inagaki ..... F02F 1/242 123/169 PA
2007/0289370 A1* 12/2007 Hirose ..... G01L 23/00 73/114.21
2010/0083741 A1* 4/2010 Scholzen ..... G01L 23/08 73/114.18

FOREIGN PATENT DOCUMENTS

JP 2008-191059 A 8/2008
JP 2010-091563 A 4/2010

* cited by examiner

*Primary Examiner* — Jacob M Amick
*Assistant Examiner* — Charles Brauch
(74) *Attorney, Agent, or Firm* — Hunton Andrews Kurth LLP

(57) ABSTRACT

An engine includes a cylinder pressure sensor inserted into a through-hole of a cylinder head. A sealing member that seals between a hole wall surface and a body-side wall surface. A dimension relationship of D1<D3×(D4/D2) is satisfied where: D1 is a distance in a direction of a central axis from a reference position of the sealing member to a first given position; D2 is a distance between the hole wall surface and the body-side wall surface at the first given position; D3 is a distance in the direction of the central axis from the reference position to a second given position; and D4 is a distance between the hole wall surface and the body-side wall surface at the second given position.

8 Claims, 10 Drawing Sheets

INTERNAL COMBUSTION ENGINE

INCORPORATION BY REFERENCE

The disclosure of Japanese Patent Application No. 2016-041002 filed on Mar. 3, 2016 including the specification, drawings and abstract is incorporated herein by reference in its entirety.

BACKGROUND

1. Technical Field

The present disclosure relates to an internal combustion engine.

2. Description of Related Art

Japanese Patent Application Publication No. 2010-091563 (JP 2010-091563 A) describes an internal combustion engine including a cylinder pressure sensor configured such that a sensor body is inserted into a through-hole provided in a cylinder head. More specifically, the internal combustion engine is provided with a sealing member for sealing between a wall surface of the through-hole and the sensor body. An end portion of the sensor body on an opposite side to an end portion thereof on a combustion-chamber side is provided with a fixed portion for fixing the sensor body to the cylinder head. The sensor body is configured to press the fixed portion against the cylinder head with the use of a clamp. This structure is designed so that the sensor body makes contact with the through-hole only via the sealing member.

SUMMARY

JP 2010-091563 A does not describe anything about a dimension relationship between the sensor body of the cylinder pressure sensor and the through-hole, including a position of the sealing member. Here, in a case where the cylinder pressure sensor is actually provided in the cylinder head, a central axis of the sensor body may be inclined inside the through-hole. Exemplary factors of the inclination may include machining accuracy of the cylinder pressure sensor and the cylinder head, poor assembly of the cylinder pressure sensor, deformation of the sensor fixed portion, deformation of the sealing member due to heat, and the like.

A pressure receiving portion of the cylinder pressure sensor is provided in the end portion of the sensor body on the combustion-chamber side. In a case where such an inclination of the central axis of the sensor body occurs, the sensor body around the pressure receiving portion may make contact with the wall surface of the through-hole depending on a state of the inclination. When the sensor body around the pressure receiving portion makes contact with the wall surface of the through-hole, a vibration caused due to an operation of the internal combustion engine is transmitted to the pressure receiving portion via the cylinder head. As a result, a noise caused due to the vibration may overlap with an output value of the cylinder pressure sensor. Such an overlap of the vibration noise may cause an error of a sensor output.

The present disclosure provides an internal combustion engine configured such that, even when a central axis of a sensor body is inclined in a through-hole, a contact between the through-hole and the sensor body around a pressure receiving portion of a cylinder pressure sensor is avoided.

An aspect of the present disclosure provides an internal combustion engine including a cylinder head, a cylinder pressure sensor, a sealing member, and a fixing member. The cylinder head has a through-hole. The cylinder pressure sensor includes a sensor body and a pressure receiving portion. The sensor body includes a fixed portion abutting with a head wall surface of the cylinder head on an opposite side to a combustion chamber of the internal combustion engine. The sensor body has a bar shape. The sensor body is placed inside the through-hole. The pressure receiving portion is provided in an end portion of the sensor body on a combustion-chamber side. The sealing member that seals between a hole wall surface as a wall surface of the through-hole and a body-side wall surface as a side wall surface of the sensor body. The fixing member is configured to fix the fixed portion such that the fixed portion is pressed against the head wall surface. The sealing member is placed in the middle of the sensor body in a direction of a central axis of the sensor body, when the sensor body is placed inside the through-hole. The sensor body and the through-hole in a reference state are configured such that at least one combination of values that can be taken as D1, D2, D3, and D4 satisfies a dimension relationship of $D1<D3\times(D4/D2)$. D1 is a distance in a direction of a central axis of the through-hole from a reference position of the sealing member to a first given position. The first given position is a position of one of the hole wall surface and the body-side wall surface placed on a side closer to the combustion engine than the sealing member. D2 is a distance between the hole wall surface and the body-side wall surface at the first given position where the hole wall surface and the body-side wall surface face to each other. D3 is a distance in the direction of the central axis of the through-hole from the reference position to a second given position. The second given position is a position of one of the hole wall surface and the body-side wall surface placed on a side farther from the combustion engine than the sealing member. D4 is a distance between the hole wall surface and the body-side wall surface at the second given position where the hole wall surface and the body-side wall surface face each other. The reference state is a state where the central axis of the through-hole is aligned with the central axis of the sensor body.

In the internal combustion engine, the through-hole may be configured such that a part distant from an end on the combustion-chamber side is larger than a part closer to the end.

According to the above configuration, it is possible to obtain the cylinder pressure sensor and the cylinder head in which the distances D1, D2, D3, and D4 about the side wall surface of the sensor body and the wall surface of the through-hole are prescribed so as to satisfy the above dimension relationship. According to the configuration obtained as such, even if the central axis of the sensor body is inclined inside the through-hole, it is possible to avoid contact between the through-hole and the sensor body around the pressure receiving portion of the cylinder pressure sensor.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
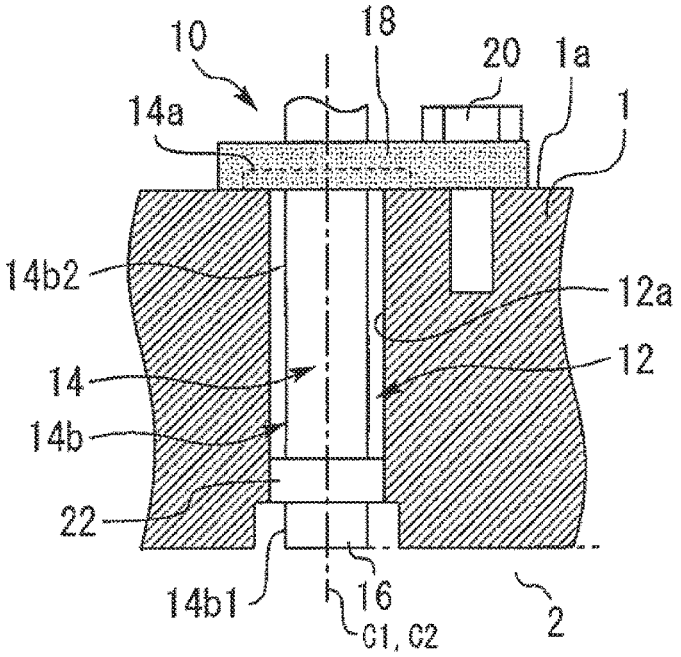
FIG. 1 is a view schematically illustrating a configuration around a cylinder pressure sensor in Embodiment 1.

With reference to the drawings, the following describes embodiments of the present disclosure. Note that identical or equivalent elements in the drawings have the same reference sign.

Embodiment 1 will be first described with reference to FIGS. 1 to 5. FIG. 1 is a view schematically illustrating a configuration around a cylinder pressure sensor 10 in Embodiment 1. The cylinder pressure sensor 10 is provided in a cylinder head 1 of an internal combustion engine. A through-hole 12 is formed in the cylinder head 1.

The cylinder pressure sensor 10 includes a bar-shaped sensor body 14. More specifically, the sensor body 14 has a cylindrical shape. The sensor body 14 is provided so as to be inserted into the through-hole 12 and is placed inside the through-hole 12. An end portion of the sensor body 14 on a combustion-chamber-side (hereinafter also just referred to as a "sensor head side") is provided with a pressure receiving portion 16 for receiving a cylinder pressure. The cylinder pressure sensor 10 is configured such that a compressive load based on the cylinder pressure is input into the pressure receiving portion 16, so as to provide an output corresponding to the compressive load thus input.

The sensor body 14 includes a fixed portion 14*a*. The fixed portion 14*a* abuts with a head wall surface 1*a* of the cylinder head 1 on an opposite side to a combustion chamber 2 (hereinafter also just referred to as a "sensor base end side"). A clamp 18 is placed so as to cover the fixed portion 14*a*. The clamp 18 is fixed to the cylinder head 1 in a state where the fixed portion 14*a* is pressed against the head wall surface 1*a* by a bolt 20. With such a configuration, the sensor body 14 is fixed to the cylinder head 1. Note that a fixation method of the cylinder pressure sensor 10 to the cylinder head 1 is not limited to one using the clamp 18 and the bolt 20 as a fixing member. The fixation of the cylinder pressure sensor 10 to the cylinder head 1 should be such that the fixed portion 14*a* of the sensor body 14 is pressed against the head wall surface 1*a* so as to fix the fixed portion 14*a*. That is, for example, the fixed portion of the sensor body may be directly fixed to the head wall surface by use of a fastener such as a bolt. Further, a sensor body constituting an outer shape of the cylinder pressure sensor may be formed of one member including the fixed portion or may be formed of a plurality of members in combination. An example of the sensor body constituted by the plurality of members in combination includes, for example, a configuration in which a member constituting a part around the fixed portion is provided as a different member from members constituting other parts.

A sealing member 22 is provided between a side wall surface (hereinafter referred to as a "body-side wall surface") 14*b* of the sensor body 14 and a wall surface (hereinafter referred to as a "hole wall surface") 12*a* of the through-hole 12 so as to prevent gas in the combustion chamber 2 from leaking outside through a gap between the body-side wall surface 14*b* and the hole wall surface 12*a*. The sealing member 22 is constituted by an elastic material. As the elastic material, fluorinated resin (PTFE (a polymer of tetrafluoroethylene) and the like) can be used, for example.

More specifically, the sealing member 22 is fitted into an annular groove (not shown) formed on the body-side wall surface 14*b*. The sealing member 22 yields a fastening force in a radial direction of the through-hole 12 in a state where the sensor body 14 is inserted into the through-hole 12, and makes contact with each of the hole wall surface 12*a* and the body-side wall surface 14*b* so as to adhere thereto. As such, the cylinder pressure sensor 10 of the present embodiment employs a so-called shaft-seal method as a seal method between the through-hole 12 and the sensor body 14.

Furthermore, the mount of the cylinder pressure sensor 10 to the cylinder head 1 is designed so that the body-side wall surface 14*b* makes contact with the hole wall surface 12*a* only via the sealing member 22 inside the through-hole 12. That is, inside the through-hole 12, no parts (a threaded part and the like) that make contact with the sensor body 14 are provided other than the sealing member 22. In a state where the sensor body 14 is inserted into the through-hole 12, the sealing member 22 is placed in the middle of the sensor body 14 in a direction of a central axis C2 of the sensor body 14. In other words, the body-side wall surface 14*b* includes a body-side wall surface 14*b*1 on a combustion-chamber-side (a sensor head side) relative to the sealing member 22, and a body-side wall surface 14*b*2 on an opposite side (a sensor base end side) to the combustion chamber 2 relative to the sealing member 22.

Subsequently, with reference to FIGS. 2A and 2B, the following describes a cylinder pressure sensor which employs a shaft-seal method and which employs a mount structure (hereinafter referred to as a "mount structure A" for convenience) in which a fixed portion of a sensor body is pressed against a head wall surface on a sensor base end side so as to be fixed. The mount structure A itself is a structure that is also employed in the cylinder pressure sensor 10 of the present embodiment as described above.

Figure 2A:
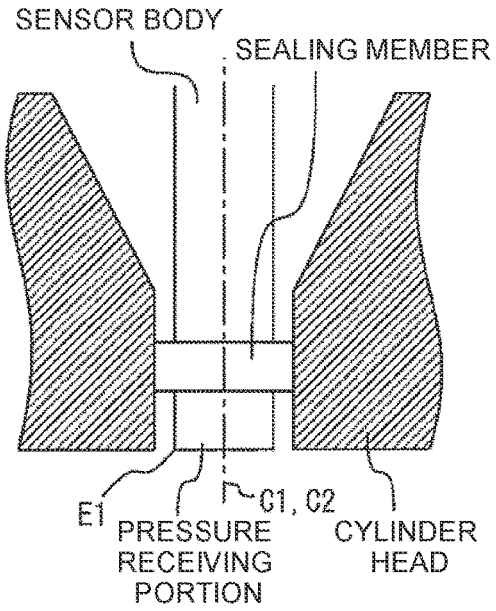
FIG. 2A is a view to describe a cylinder pressure sensor which employs a shaft-seal method and which employs a mount structure A in which a fixed portion of a sensor body is pressed against a head wall surface on a sensor base end side so as to be fixed.

FIG. 2A illustrates a desirable mount state of the cylinder pressure sensor. This example particularly illustrates a state where a central axis C2 of the sensor body is aligned with a central axis C1 of a through-hole. In the meantime, FIG. 2B illustrates a state where the central axis C2 of the sensor body is greatly inclined relative to the central axis C1 of the through-hole. Exemplary factors that cause such inclination of the sensor body include machining accuracy of the cylinder pressure sensor and the cylinder head, poor assembly of the cylinder pressure sensor, deformation of a sensor fixed portion, deformation of the sealing member due to heat, and the like.

Figure 2B:
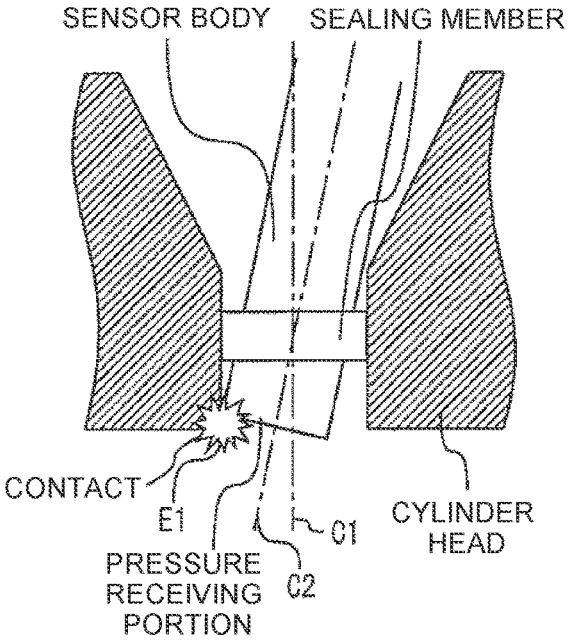
FIG. 2B is a view to describe the cylinder pressure sensor which employs a shaft-seal method and which employs the mount structure A in which the fixed portion of the sensor body is pressed against the head wall surface on the sensor base end side so as to be fixed.

FIG. 2B illustrates an exemplary configuration in which, when the sensor body is inclined, an end portion of a body-side wall surface on a sensor head side makes contact with a hole wall surface. A pressure receiving portion is provided in the end portion on the sensor head side. Accordingly, when the sensor body around the pressure receiving portion makes contact with the hole wall surface, a vibration caused due to an operation of the internal combustion engine is transmitted to the pressure receiving portion via the cylinder head. As a result, a noise caused due to the vibration may overlap with an output value of the cylinder pressure sensor. Such an overlap of the vibration noise may cause an error of a sensor output. Further, a level of such a vibration noise increases as a part of the sensor body, the part making contact with the hole wall surface, is closer to an end E1 on the sensor head side, and the level of the vibration noise decreases as the part is farther from the end E1.

Figure 3:
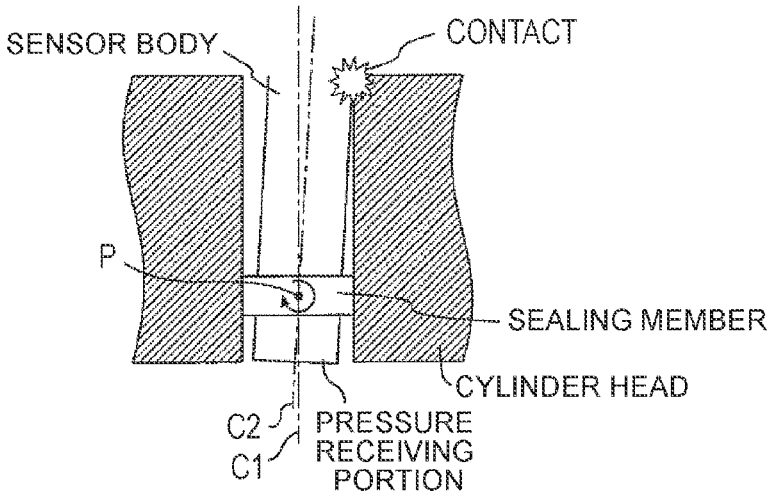
FIG. 3 is a view illustrating one example of a configuration when the mount structure A is employed.

In the meantime, FIG. 3 is a view illustrating an example of a configuration that takes measures to a case where the end portion of the body-side wall surface on the sensor head side makes contact with the hole wall surface when the mount structure A is employed. The inclination of the central axis C2 of the sensor body can be considered to occur around a center point (a center point in a thickness direction and in a radial direction) P of the sealing member, as illustrated in FIG. 3. The configuration illustrated in FIG. 3 is a configuration that takes measures to be described later with reference to FIG. 4 (to satisfy a special dimension relationship between the hole wall surface and the body-side wall surface).

First, the following describes results of the measures first. In the configuration illustrated in FIG. 3, at the time when the central axis C2 is inclined, the body-side wall surface on the sensor base end side relative to the sealing member makes contact with the hole wall surface earlier than the body-side wall surface on the sensor head side relative to the sealing member, so that the sensor body is not inclined further from this state. On this account, in a case of the above configuration, even if the central axis C2 is inclined, it is possible to prevent the pressure receiving portion provided in the sensor head side from making contact with the hole wall surface.

Figure 4:
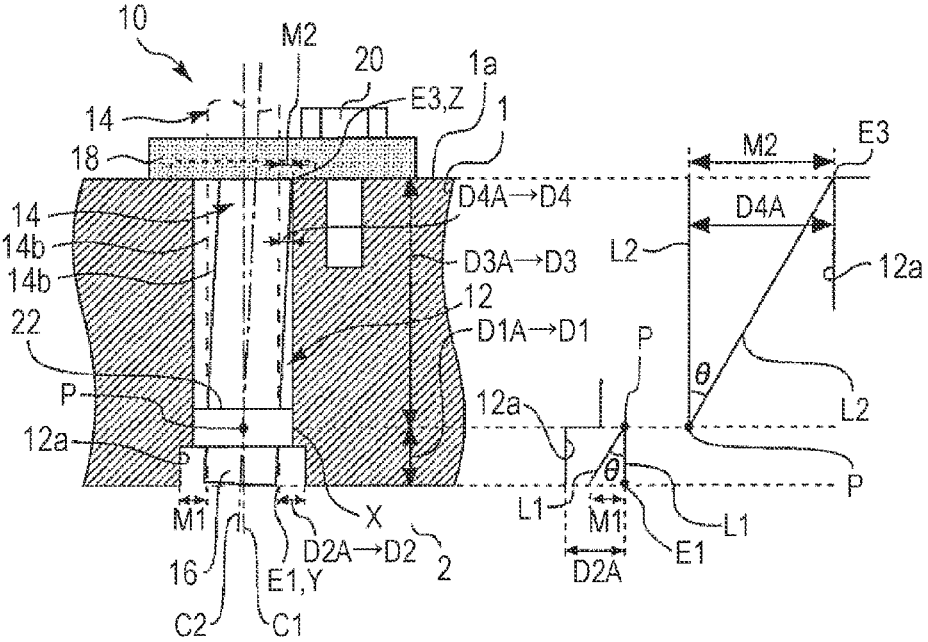
FIG. 4 is a view to describe Embodiment 1.

FIG. 4 is a view to describe Embodiment 1. The end portion of the body-side wall surface on the sensor head side makes contact with the hole wall surface as illustrated in the example of FIG. 2B because of setting of a dimension relationship between the hole wall surface and the body-side wall surface, including a position of the sealing member. The body-side wall surface 14*b* indicated by a broken line in FIG. 4 shows a reference state where the central axis C1 of the through-hole 12 is aligned with the central axis C2 of the sensor body 14, similarly to FIG. 1. In the meantime, the body-side wall surface 14*b* indicated by a continuous line shows a state where the body-side wall surface 14*b* on the sensor base end side makes contact with the hole wall surface 12*a* along with the inclination of the central axis C2.

Here, as illustrated in FIG. 4, in terms of shapes of the sensor body 14 and the through-hole 12 of Embodiment 1, dimensions of respective parts in the reference state are defined as follows.

1. A distance in a direction of the central axis C1 of the through-hole 12 from a reference position X of the sealing member 22 to a given position Y of the hole wall surface 12*a* or the body-side wall surface 14*b* placed on a side closer to the combustion chamber 2 than the sealing member 22 is assumed D1.
2. A distance between the hole wall surface 12*a* and the body-side wall surface 14*b* at the given position Y where the hole wall surface 12*a* and the body-side wall surface 14*b* face to each other is assumed D2.
3. A distance in the direction of the central axis C1 of the through-hole 12 from the reference position X to a given position Z of the hole wall surface 12*a* or the body-side wall surface 14*b* placed on a side farther from the combustion chamber 2 than the sealing member 22 is assumed D3.
4. A distance between the hole wall surface 12*a* and the body-side wall surface 14*b* at the given position Z where the hole wall surface 12*a* and the body-side wall surface 14*b* face each other is assumed D4.

In the present embodiment, as concrete examples of values that can be taken as the distances D1 to D4 defined as described above, the following distances D1A to D4A are used. In the present embodiment, as an example of the reference position X of the sealing member 22, a center (hereinafter abbreviated as a "seal center") of the sealing member 22 in the thickness direction is used.

That is, D1A is a distance in the central-axis-C1 direction from the seal center to an end (a sensor head) E1 (an example of the "given position Y") of the body-side wall surface 14*b* on the combustion-chamber-side. D2A is a distance between the hole wall surface 12*a* and the body-side wall surface 14*b* at the end E1 (the given position Y), where the hole wall surface 12*a* and the body-side wall surface 14*b* face each other, of the body-side wall surface 14*b*. D3A is a distance in the central-axis-C1 direction from the seal center (the reference position X) to an end E3 (an example of the "given position Z") of the hole wall surface 12*a* on an opposite side (the sensor base end side) to the combustion chamber 2. D4A is a distance between the hole wall surface 12*a* and the body-side wall surface 14*b* at the end E3 (the given position Z), where the hole wall surface 12*a* and the body-side wall surface 14*b* face each other, of the hole wall surface 12*a*.

In order to prevent the end portion of the body-side wall surface on the sensor head side from making contact with the hole wall surface, the dimension relationship of respective parts should be set so as to satisfy a condition in which, when the central axis C2 is inclined, the body-side wall surface 14*b*2 on the sensor base end side makes contact with the hole wall surface 12*a* earlier than the body-side wall surface 14*b*1 on the sensor head side. Here, as a moving amount (more specifically, a moving amount in a direction perpendicular to the central axis C1) along with the inclination of the sensor body 14, a moving amount of the end E1 of the body-side wall surface 14*b*1 is assumed M1, and a moving amount of a part S3 of the body-side wall surface 14*b*2, the part S3 corresponding to the end E3, is assumed M2. In order to satisfy the above relationship, it may be said that a difference between D2A and M1 (D2A−M1) should be larger than a difference between D4A and M2 (D4A−M2) as shown in Expression (1) as follows.

$$D2A-M1>D4A-M2 \quad (1)$$

FIG. 4 illustrates a state where the part of the body-side wall surface 14*b*2, the part being opposed to the end E3, makes contact with the end E3. When the central axis C2 is inclined, a line L1 and a line L2 indicating the body-side wall surface 14*b*1 and the body-side wall surface 14*b*2, respectively, are inclined while being maintained parallel to the central axis C2. On this account, an angle θ in FIG. 4 corresponds to an amount of the inclination of the central axis C2 at the time when this contact state is obtained. In a state where the part of the body-side wall surface 14*b*2 makes contact with the end E3, the moving amount M2 is equal to the distance D2A, so the right side in Expression (1) is zero. Accordingly, Expression (2) is provided as follows. Here, M1 is a product of the distance D1A and tan θ, so Expression (2) can be expressed as Expression (3) as follows. Further, in the state illustrated in FIG. 4, tan θ is a ratio (D4A/D3A) of D4A to D3A. Accordingly, when Expression (3) is transformed and D1A to D4A used in Expression (3) are generalized to D1 to D4, Expression (4) can be obtained ultimately.

$$D2A-M1>0 \quad (2)$$

$$D2A-D1A\times\tan\theta>0 \quad (3)$$

$$D1<D3\times(D4/D2) \quad (4)$$

According to Expression (4), a relationship required to prevent the end portion of the body-side wall surface on the sensor head side from making contact with the hole wall surface can be expressed by a dimension relationship between the body-side wall surface 14*b* and the hole wall surface 12*a* (a dimension relationship including the position of the sealing member 22). In the present embodiment, shapes of the sensor body 14 and the through-hole 12, including the position of the sealing member 22, are determined so that the distances D1A to D4A satisfying the dimension relationship shown in Expression (4) can be obtained.

According to the configuration of the present embodiment described above, the dimension relationship shown by Expression (4) is satisfied. Accordingly, even if the central axis C2 of the sensor body 14 might be inclined at the time of assembling the cylinder pressure sensor 10 to the cylinder head 1 or during an operation, it is possible to prevent the pressure receiving portion 16 provided on the sensor head side from making contact with the hole wall surface 12*a*.

Figure 5:
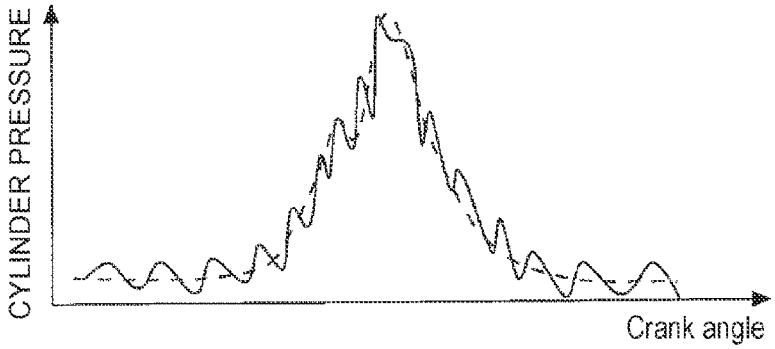
FIG. 5 is a view to describe a cylinder pressure waveform of Embodiment 1.

FIG. 5 is a view to describe a cylinder pressure waveform of Embodiment 1. In a case where the pressure receiving portion makes contact with the hole wall surface like the configuration illustrated in FIG. 2B, a noise caused due to an engine vibration (not an electric noise) overlaps with an output waveform of the cylinder pressure sensor like a waveform indicated by a continuous line in FIG. 5. In this regard, according to the configuration of the present embodiment that satisfies the dimension relationship shown by Expression (4), an output waveform with which the noise does not overlap is obtained like a waveform indicated by a broken line in FIG. 5.

Furthermore, the configuration of the present embodiment uses the sensor body 14 including the body-side wall surface 14*b* having a straight shape, and the through-hole 12 in which the hole wall surface 12*a* on the sensor base end side relative to the sealing member 22 has a straight shape, as described above. In such a relatively simple configuration, in order to obtain such an effect that the pressure receiving portion 16 does not make contact with the hole wall surface 12*a*, the distances D1A to D4A obtained when the end E1 of the body-side wall surface 14*b* is assumed the given position Y and the end E3 of the hole wall surface 12*a* is assumed the given position Z are focused, and D1A to D4A are just set to satisfy Expression (4). However, in order to obtain the above effect in the present disclosure, it may be said that at least one of given combinations of the values that can be taken as the distances D1 to D4 defined as above should satisfy Expression (4). Further, the "values that can be taken as the distances D1 to D4" are additionally described as follows.

That is, as can be understood from the abovementioned definitions of distances D1 and D2, in order that a position, in the central-axis-C1 direction, of the body-side wall surface or the hole wall surface corresponds to the "given position Y," it is required that the body-side wall surface faces the hole wall surface at that position. Accordingly, for example, in an end E1 of a body-side wall surface 102*a* in an exemplary configuration illustrated in FIG. 14 to be described later, a body-side wall surface 102*a* is not faced a hole wall surface 60*a*1, so the end E1 does not correspond to the "given position Y" In the exemplary configuration, a position within a range from a seal center to an end E2 of the hole wall surface 60*a*1 corresponds to the "given position Y," and further, is targeted for calculation of values that can be taken as the distances D1 and D2. The same can be applied to the distances D3 and D4.

Figure 6:
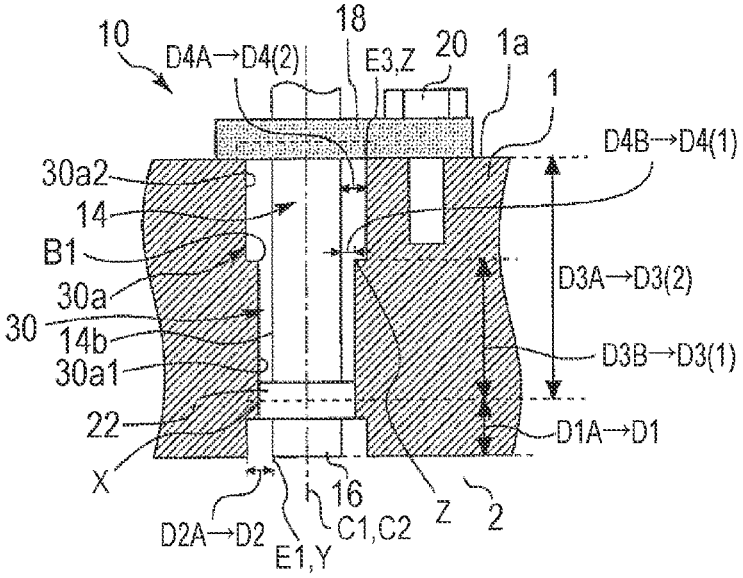
FIG. 6 is a view schematically illustrating a configuration around a cylinder pressure sensor in Embodiment 2.

With reference to FIG. 6, the following describes Embodiment 2 of the present disclosure. FIG. 6 is a view schematically illustrating a configuration around a cylinder pressure sensor 10 in Embodiment 2. This configuration is different from the configuration of Embodiment 1 in terms of a shape of a through-hole. That is, as illustrated in FIG. 6, in a hole wall surface 30*a* of a through-hole 30 on a sensor base end side relative to a sealing member 22, a diameter of a hole wall surface 30*a*2 farther from the sealing member 22 is larger than a diameter of a hole wall surface 30*a*1 closer to the sealing member 22. FIG. 6 illustrates a reference state where a central axis C1 of the through-hole 30 is aligned with a central axis C2 of a sensor body 14. Note that, about FIGS. 7, 8, and 10 to 15 after Embodiment 3, a reference state is illustrated similarly to FIG. 6.

The configuration of Embodiment 2 has the through-hole 30 in which a shape of the hole wall surface 30*a* changes in a stepped manner as described above. As illustrated in FIG. 6, a distance of the hole wall surface 30*a*1 from a seal center to a bent portion B1 is uniform at D4(1), and a distance of the hole wall surface 30*a*2 on a sensor base end side relative to the bent portion B1 is uniform at D4(2). In this configuration, in order to prevent a body-side wall surface 14*b*1 around a pressure receiving portion 16 from making contact with the hole wall surface 30*a* even if the central axis C2 is inclined, it is adequate to use the bent portion B1 and the end E3 most distant from the sealing member 22 in the hole wall surfaces 30*a*1, 30*a*2, respectively. Accordingly, as values that can be taken as the distances D1 to D4 defined in Embodiment 1, it is appropriate to use the following concrete examples.

1. First, definition of distances D1A, D2A, D3A, and D4A are the same as those in Embodiment 1.

2. A distance from the seal center to the bent portion B1 (corresponding to an example of the given position Z) of the through-hole 30 is assumed D3B. More specifically, the bent portion B1 is a bent portion having a shape of the hole wall surface 30*a* that changes in a stepped manner, and is a bent portion (a corner part) that projects toward a counterpart (a sensor-body-14 side).

3. A distance between the hole wall surface 30*a* and the body-side wall surface 14*b* at the bent portion B1 (the given position Z), where the hole wall surface 30*a* and the body-side wall surface 14*b* face each other, is assumed D4B.

In a case where the bent portion B1 is provided like the through-hole 30 of the present embodiment, parts to be focused to solve the above problem in the hole wall surface 30*a* on the sensor base end side relative to the sealing member 22 are the end E3 of the hole wall surface 30*a* and the bent portion B1. Respective shapes of the sensor body 14 and the through-hole 30 should be determined including a position of the sealing member 22 so that at least one of a combination of D3(2) and D4(2) about the end E3 and a combination of D3(1) and D4(1) about the bent portion B1 satisfies a dimension relationship shown by Expression (5) having the same significance as Expression (4).

$$D1<D3(k)\times(D4(k)/D2) \quad (5)$$

Note that, in Expression (5), D3(*k*) and D4(*k*) correspond to k-th distances to be targeted for the calculation in a relational expression shown by Expression (5). Accordingly, in the case of the through-hole 30, 1 or 2 is substituted into a variable k in Expression (5). Note that the relational expression shown by Expression (5) can be expanded to the bent portion targeted for the calculation or the after-mentioned through-hole including a plurality of curved portions.

In an example of the shapes of the sensor body 14 and the through-hole 30 illustrated in FIG. 6, D3(2) and D4(2) about the end E3 and D3(1) and D4(1) about the bent portion B1 both satisfy a dimension relationship shown by Expression (5). In such a case, when the central axis C2 is inclined, one with a severer condition, out of the end E3 and the bent portion B1, makes contact with the body-side wall surface 14*b*2 on the sensor base end side earlier than the other one, so as to restrict the central axis C2 from being inclined more from this contact. According to the configuration of the present embodiment described above, it is also possible to prevent the pressure receiving portion 16 from making contact with the hole wall surface 30*a* even if the central axis C2 is inclined.

Figure 7:
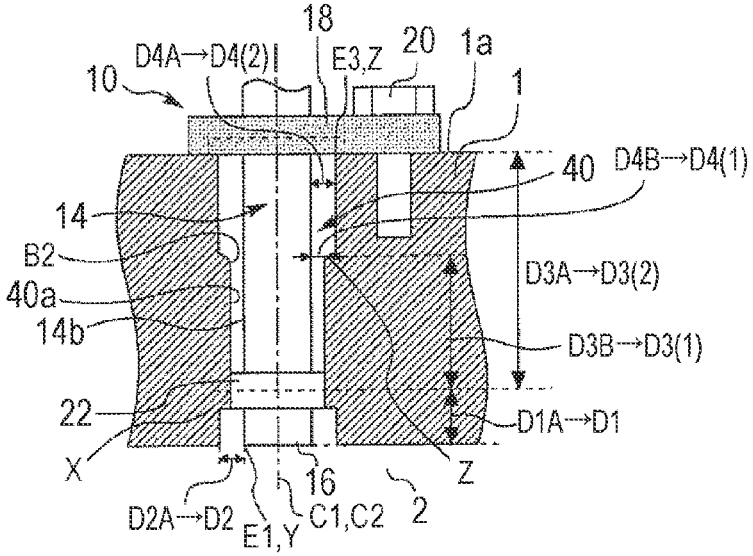
FIG. 7 is a view schematically illustrating a configuration around a cylinder pressure sensor in Embodiment 3.

With reference to FIG. 7, the following describes Embodiment 3 of the present disclosure. FIG. 7 is a view schematically illustrating a configuration around a cylinder pressure sensor 10 in Embodiment 3. This configuration is different from the configuration of Embodiment 2 in terms of a shape of a through-hole. That is, in a through-hole 40 illustrated in FIG. 7, a part where a shape of a hole wall surface 40*a* changes in a stepped manner is formed as a round curved portion B2.

The configuration of the present embodiment includes the through-hole 40 having the curved portion B2 as described above. In this configuration, in order to prevent a body-side wall surface 14*b*1 around a pressure receiving portion around 16 from making contact with the hole wall surface 40*a* even if a central axis C2 is inclined, it is appropriate to use the following concrete example as values that can be taken as the distances D1 to D4 defined in Embodiment 1. Note that Embodiment 3 is the same as Embodiment 2 except that D3(1) and D4(1) about the curved portion B2 are defined as follows.

1. A distance from a seal center to the curved portion B2 (corresponding to an example of the given position Z) of the through-hole 40 is assumed D3B. More specifically, the curved portion B2 is a curved portion having a shape of the hole wall surface 40*a* that changes in a stepped manner, and is a curved portion that projects toward a counterpart (a sensor-body-14 side).

2. A distance between the hole wall surface 40*a* and the body-side wall surface 14*b* at the curved portion B2 (the given position Z), where the hole wall surface 40*a* and the body-side wall surface 14*b* face each other, is assumed D4B.

In the meantime, the configuration of Embodiment 2, illustrated in FIG. 6, includes the bent portion B1, and the configuration of Embodiment 3, illustrated in FIG. 7, includes the curved portion B2. In this regard, a through-hole having the bent portion B1 and the curved portion B2 may be targeted so as to obtain a configuration that satisfies the dimension relationship shown by Expression (5).

Figure 8:
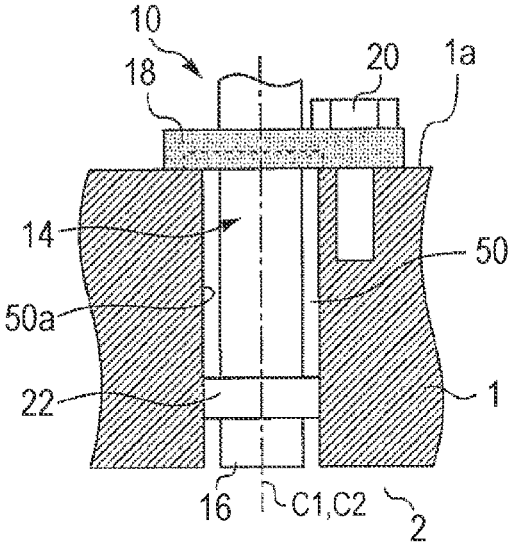
FIG. 8 is a view schematically illustrating a configuration around a cylinder pressure sensor in Embodiment 4.
Figure 9:
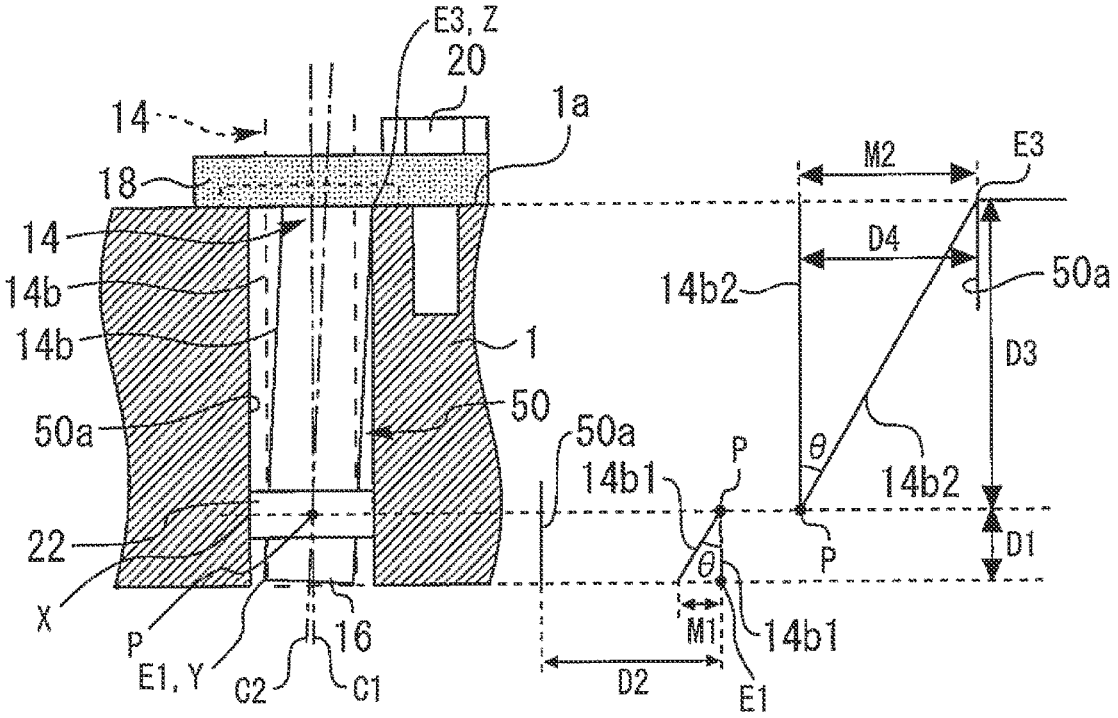
FIG. 9 is a view to describe Embodiment 4.

With reference to FIGS. 8 and 9, the following describes Embodiment 4 of the present disclosure. FIG. 8 is a view schematically illustrating a configuration around a cylinder pressure sensor 10 in Embodiment 4. This configuration is different from the configuration of Embodiment 1 in terms of a shape of a through-hole. That is, a through-hole 50 has a hole wall surface 50*a* having a straight shape without a shape change due to the bent portion B1, the curved portion B2, or the like, as illustrated in FIG. 8.

FIG. 9 is a view to describe measures to a case where an end portion of the body-side wall surface on a sensor head side makes contact with the hole wall surface, the measures being used in Embodiment 4. In this configuration, as mentioned earlier, the through-hole 50 has a straight shape, and further, a shape of the sensor body 14 is also a straight shape. Because of this, in this configuration, D2 and D4 are equal to each other. Accordingly, when a dimension relationship shown in this configuration is substituted in Expression (4) or (5), Expression (6) is obtained.

$$D1<D3 \quad (6)$$

As can be seen from Expression (6), in a case of the configuration in which the through-hole 50 and the sensor body 14 are both formed in a straight shape, a position of a sealing member 22 should be determined so that the distance D3 is longer than the distance D1. FIG. 9 illustrates an example of a configuration to which this idea is applied so that the distance D1 is longer than the distance D3. Even according to the present embodiment described above, it is possible to prevent the pressure receiving portion 16 from making contact with the hole wall surface 50*a* even if the central axis C2 is inclined.

Figure 10:
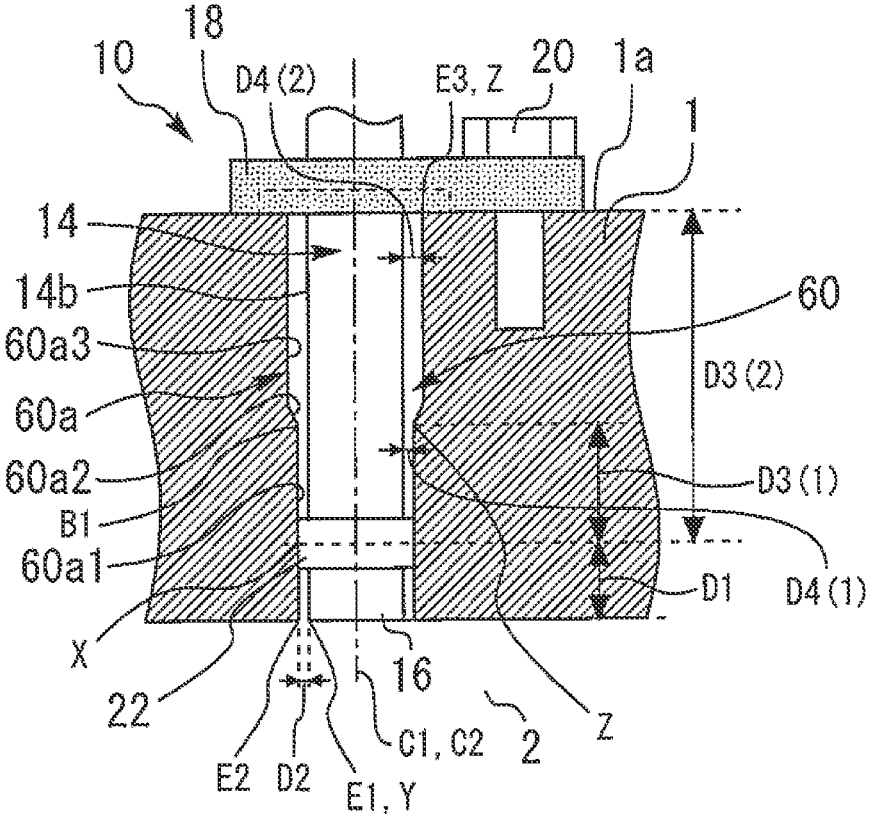
FIG. 10 is a view schematically illustrating a configuration around a cylinder pressure sensor in Embodiment 5.

With reference to FIG. 10, the following describes Embodiment 5 of the present disclosure. FIG. 10 is a view schematically illustrating a configuration around a cylinder pressure sensor 10 in Embodiment 5. This configuration is different from the configuration of Embodiment 2 in terms of a shape of a through-hole. That is, as illustrated in FIG. 10, a hole wall surface 60*a* of a through-hole 60 has a hole wall surface 60*a*1, a tapered portion 60*a*2, and a hole wall surface 60*a*3. The hole wall surface 60*a*1 is a part on a sensor head side and is a part that makes contact with a sealing member 22 and has a smallest distance at which the hole wall surface 60*a*1 and a body-side wall surface 14*b* face each other. The body-side wall surface 14*b* has a straight shape. The tapered portion 60*a*2 is a part where a diameter of the through-hole 60 changes continuously. The hole wall surface 60*a*3 is a part on a sensor base end side and is a largest distance at which the hole wall surface 60*a*3 and the body-side wall surface 14*b* face each other. More specifically, the tapered portion 60*a*2 is formed such that a diameter on the sensor head side is small and a diameter on the sensor base end side is large. As such, the diameter of the through-hole 60 is larger in a part farther from an end E2 on the sensor head side (a combustion-chamber-side) than in a part closer to the end E2.

In the configuration illustrated in FIG. 10, respective shapes of a sensor body 14 and the through-hole 60 are also determined so as to satisfy the dimension relationship shown in Expression (5) by applying the technique described in Embodiment 2. Note that, in a case of this configuration, an end of the tapered portion 60*a*2 on the sensor head side (that is, a bent portion that projects toward a counterpart (a sensor-body-14 side)) should be chosen as a bent portion B1 targeted for calculation of a distance D3(1) and a distance D4(1).

Further, the through-hole 60 illustrated in FIG. 10 includes a tapered portion 60*a*2 widened toward the sensor base end side. This makes it possible to improve insertability of the sensor body 14 at the time of assembly while avoiding contact between a part around the pressure receiving portion around 16 and the through-hole 60 along with the inclination of the sensor body 14.

Figure 11:
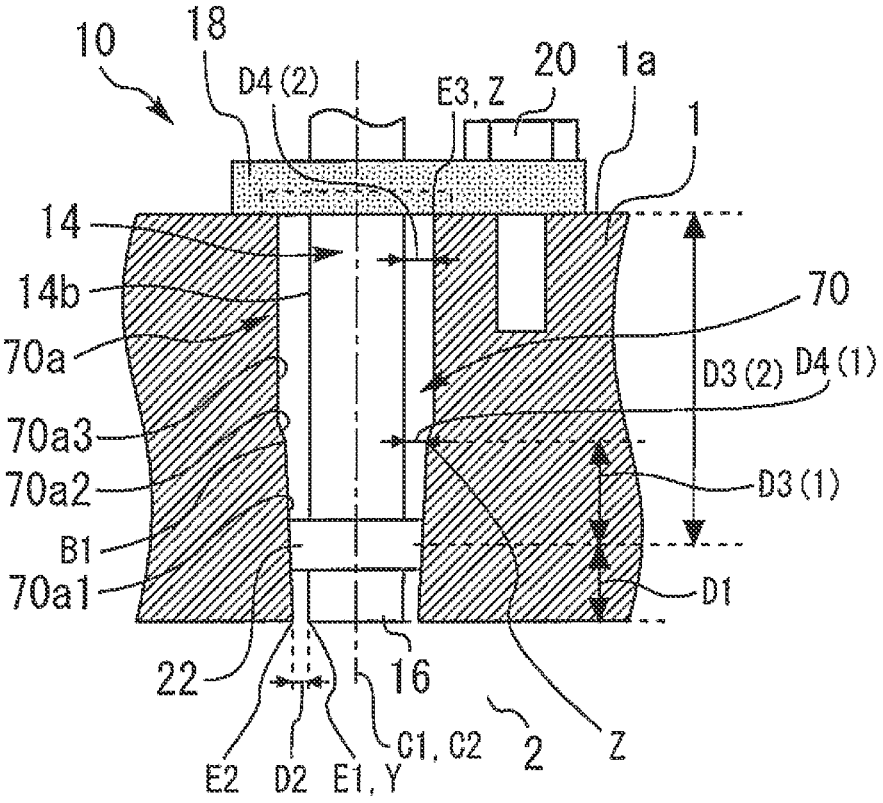
FIG. 11 is a view schematically illustrating a configuration around a cylinder pressure sensor in Embodiment 6.

With reference to FIG. 11, the following describes Embodiment 6 of the present disclosure. FIG. 11 is a view schematically illustrating a configuration around a cylinder pressure sensor 10 in Embodiment 6. This configuration is different from the configuration of Embodiment 5 in terms of a shape of a through-hole, and as illustrated in FIG. 11, a hole wall surface 70*a* of a through-hole 70 has a two-step tapered shape. That is, the hole wall surface 70*a* has a tapered portion 70*a*1, a tapered portion 70*a*2, and a hole wall surface 70*a*3. The tapered portion 70*a*1 is a part on a sensor head side, and is a part which makes contact with a sealing member 22 and in which a diameter of the through-hole 70 changes continuously. The tapered portion 70*a*2 and the hole wall surface 70*a*3 are parts similar to the tapered portion 60*a*2 and the hole wall surface 60*a*3 illustrated in FIG. 10, respectively. The tapered portion 70*a*1 and the tapered portion 70*a*2 are formed such that a diameter on the sensor head side is small and a diameter on a sensor base end side is large, similarly to the tapered portion 60*a*2.

In the configuration illustrated in FIG. 11, respective shapes of a sensor body 14 and the through-hole 70, including a position of the sealing member 22, are determined so as to satisfy the dimension relationship shown in Expression (5), similarly to Embodiment 5. Further, in the through-hole 70 illustrated in FIG. 11, a part where the sealing member 22 is finally fitted in a mount state is the tapered portion 70*a*1 widened toward the sensor base end side. This makes it possible to avoid contact between a part around the pressure receiving portion around 16 and the through-hole 70 along with the inclination of the sensor body 14 and to further improve the insertability of the sensor body 14 at the time of assembly in comparison with a case where the through-hole 60 illustrated in FIG. 10 is used.

Figure 12:
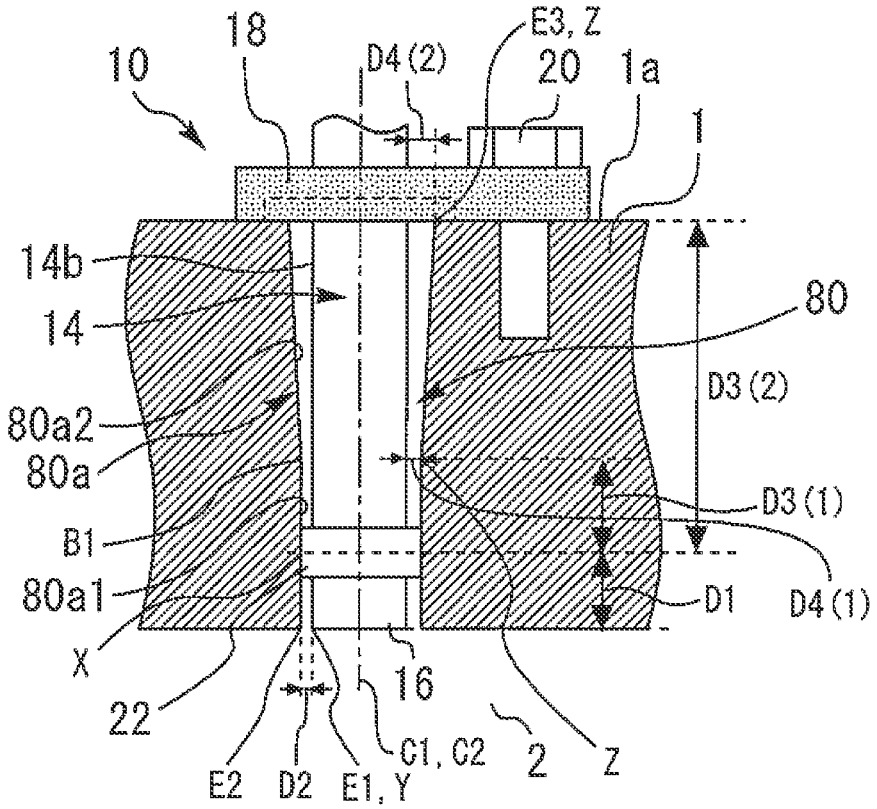
FIG. 12 is a view schematically illustrating a configuration around a cylinder pressure sensor in Embodiment 7.

With reference to FIG. 12, the following describes Embodiment 7 of the present disclosure. FIG. 12 is a view schematically illustrating a configuration around a cylinder pressure sensor 10 in Embodiment 7. This configuration is different from the configuration of Embodiment 5 in terms of a shape of a through-hole. That is, as illustrated in FIG. 12, a hole wall surface 80*a* of a through-hole 80 has a hole wall surface 80*a*1 and a tapered portion 80*a*2. The hole wall surface 80*a*1 is a part on a sensor head side. The hole wall surface 80*a*1 is a part that makes contact with a sealing member 22. The hole wall surface 80*a*1 has a smallest distance at which the hole wall surface 80*a*1 and a body-side wall surface 14*b* having a straight shape face each other. The tapered portion 80*a*2 is a part where a diameter of the through-hole 80 changes continuously and more specifically, is formed such that a diameter on the sensor head side is small and a diameter on a sensor base end side is large. In the through-hole 80, an end of the tapered portion 80*a*2 on the sensor base end side is equal to an end E3 of the through-hole 80 on the sensor base end side.

In the configuration illustrated in FIG. 12, respective shapes of a sensor body 14 and the through-hole 80, including a position of the sealing member 22, are also determined so as to satisfy the dimension relationship shown in Expression (5), similarly to Embodiment 5. Further, with this configuration using the tapered portion 80*a*2, it is also possible to improve insertability of the sensor body 14 at the time of assembly while avoiding contact between a part around the pressure receiving portion around 16 and the through-hole 80 along with the inclination of the sensor body 14.

Figure 13:
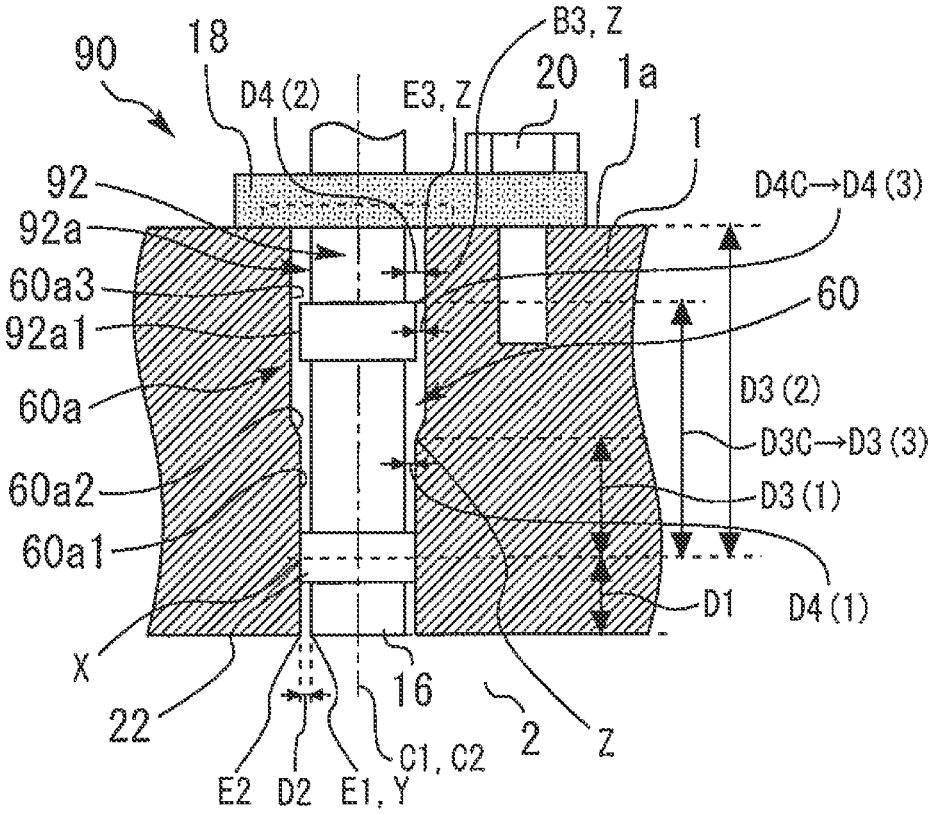
FIG. 13 is a view schematically illustrating a configuration around a cylinder pressure sensor in Embodiment 8.

With reference to FIG. 13, the following describes Embodiment 8 of the present disclosure. FIG. 13 is a view schematically illustrating a configuration around a cylinder pressure sensor 90 in Embodiment 8. This configuration is different from the configuration of Embodiment 5 in terms of a shape of a sensor body. That is, as illustrated in FIG. 13, a body-side wall surface 92*a* of a sensor body 92 includes a large-diameter portion 92*a*1. The large-diameter portion 92*a*1 is formed so as to partially project toward a hole-wall-surface-60*a*3 side in a part opposed to a hole wall surface 60*a*3, as an example. Thus, the sensor body 92 is formed in a bar shape, and more specifically, has a cylindrical basic shape. Note that, in FIG. 13, a through-hole 60 is used as an example of a through-hole to be assembled with the cylinder pressure sensor 90 having such a sensor body 92.

In the configuration illustrated in FIG. 13, respective shapes of the sensor body 92 and the through-hole 60, including a position of a sealing member 22, are also determined so as to satisfy the dimension relationship shown in Expression (5) by applying the technique described in Embodiment 2, similarly to Embodiment 5. Note that, in a case of this configuration, in addition to the part used for the calculation in Embodiment 5, an end of the large-diameter portion 92*a*1 on a sensor base end side (that is, a bent portion that projects toward a counterpart (a sensor-body-14 side)) should be chosen as a bent portion B3 targeted for calculation of a distance D3(3) (=D3C) and a distance D4(3) (=D4C).

Furthermore, the large-diameter portion 92*a*1 may be a part intentionally provided to solve the abovementioned problem, or a part that is required in the structure of the cylinder pressure sensor and has a shape that changes may be used. Further, a part targeted for the calculation so as to satisfy the dimensional relationship of Expression (5) in the large-diameter portion formed in the sensor body may be a round curved portion instead of the bent portion or in addition to the bent portion.

Figure 14:
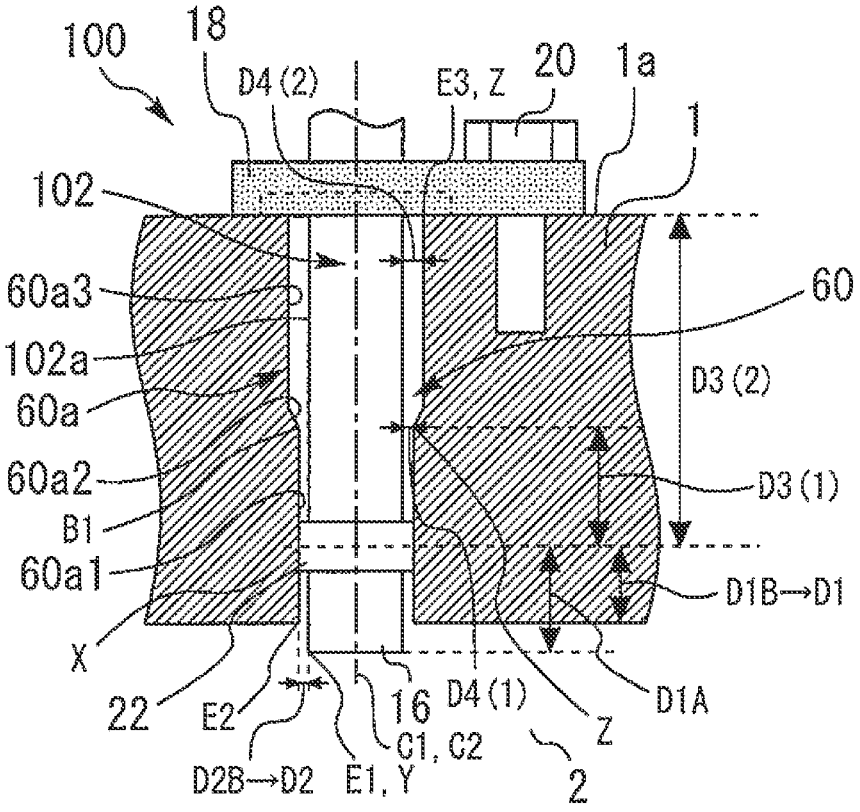
FIG. 14 is a view schematically illustrating a configuration around a cylinder pressure sensor in Embodiment 9.

With reference to FIG. 14, the following describes Embodiment 9 of the present disclosure. FIG. 14 is a view schematically illustrating a configuration around a cylinder pressure sensor 100 in Embodiment 9. This configuration is different from the configuration of Embodiment 5 in terms of a shape of a sensor body. That is, in the configurations described in Embodiments 1 to 8, the distance D1A from the seal center to the end E1 of the sensor body 14 or the like on the sensor head side and the distance D1B from the seal center to the end E2 of the through-hole 12 or the like on the sensor head side are both equal to the distance D1.

In contrast, a sensor body 102 illustrated in FIG. 14 is configured such that a distance D1A from a seal center to an end E1 of the sensor body 102 is longer than a distance D1B from the seal center to an end E2 of a through-hole 60. Note that, in FIG. 14, the through-hole 60 is used as an example of a through-hole to be assembled with a cylinder pressure sensor 100 having such a sensor body 102.

In a case of this configuration, as the distance D1 calculated so as to satisfy the dimension relationship shown in Expression (5), the distance D1B, which is short one of the distances D1A and D1B, should be used. As the distance D2, a distance D2B between the end E2 of the through-hole 60 and the body-side wall surface 102*a* should be used.

Figure 15:
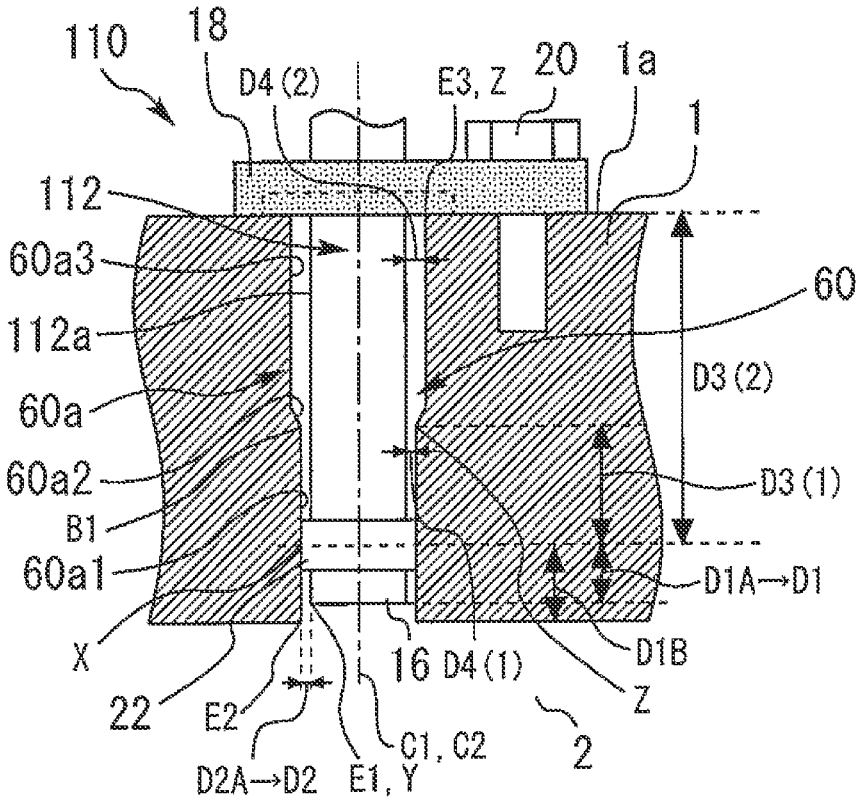
FIG. 15 is a view schematically illustrating a configuration around a cylinder pressure sensor in Embodiment 10.

With reference to FIG. 15, the following describes Embodiment 10 of the present disclosure. FIG. 15 is a view schematically illustrating a configuration around a cylinder pressure sensor 110 in Embodiment 10. This configuration is different from the configuration of Embodiment 9 in terms of a shape of a sensor body. That is, a sensor body 112 illustrated in FIG. 15 is configured such that a distance D1A from a seal center to an end E1 of the sensor body 112 is shorter than a distance D1B from the seal center to an end E2 of a through-hole 60, differently from the sensor body 102 illustrated in FIG. 14.

In a case of this configuration, as the distance D1 calculated so as to satisfy the dimension relationship shown in Expression (5), the distance D1A, which is shorter one of the distances D1A and D1B, should be used. As the distance D2, a distance D2A between the end E1 of the sensor body 112 and a hole wall surface 60*a* (60*a*1) should be used.

In the meantime, Embodiments 1 to 10 describe examples in which the distances D1 and D3 are found as the distance from the seal center (the center of the sealing member 22 in the thickness direction). However, the reference position X of the sealing member to calculate the distances D1 and D3 in the central-axis-C1 direction of the through-hole may be a position except the seal center. That is, the reference position X may be an end of the sealing member on the sensor head side in the central-axis-C1 direction or an end thereof on the sensor base end side, for example.

Further, in a case where a part that changes a shape of the body-side wall surface is provided like the large-diameter portion 92*a*1 in Embodiment 8, the part is not limited to a part integrally formed in the sensor body, but also includes a part to be obtained by fitting another member such as a collar into the sensor body. This is because a side wall surface of the collar functions as a part of the body-side wall surface, in this case. Further, the same can be applied to a part that changes a shape of the hole wall surface in the through hole, such as a tapered portion or a stepped portion.

Further, examples and modified example of the embodiments described above may be combined appropriately within a possible range as well as the combinations stated above clearly. In addition, the present disclosure may be modified variously without departing from the gist of the present disclosure.

What is claimed is:

1. An internal combustion engine comprising:

a cylinder head having a through-hole;

a cylinder pressure sensor including a sensor body and a pressure receiving portion, the sensor body including a fixed portion abutting with a head wall surface of the cylinder head on an opposite side to a combustion chamber of the internal combustion engine, the sensor body having a bar shape, the sensor body being placed inside the through-hole, the pressure receiving portion being provided in an end portion of the sensor body on a combustion-chamber-side;

an elastic sealing member that seals between a hole wall surface as a wall surface of the through-hole and a body-side wall surface as a side wall surface of the sensor body; and a clamp configured to fix the fixed portion such that the fixed portion is pressed against the head wall surface, wherein the sealing member is placed in a middle of the sensor body in a direction of a central axis of the sensor body, when the sensor body is placed inside the through-hole;

the sensor body and the through-hole in a reference state are configured such that at least one combination of values that are taken as D1, D2, D3, and D4 satisfies a dimension relationship of $D1<D3\times(D2/D4)$;

D1 is a distance in a direction of a central axis of the through-hole from a reference position of the sealing member to a first given position, the first given position being a position of one of the hole wall surface and the body-side wall surface placed on a side closer to the combustion engine than the sealing member;

D2 is a distance between the hole wall surface and the body-side wall surface at the first given position where the hole wall surface and the body-side wall surface face each other;

D3 is a distance in the direction of the central axis of the through-hole from the reference position to a second given position, the second given position being a position of one of the hole wall surface and the body-side wall surface placed on a side farther from the combustion engine than the sealing member;

D4 is a distance between the hole wall surface and the body-side wall surface at the second given position where the hole wall surface and the body-side wall surface face each other;

the reference state is a state where the central axis of the through-hole is aligned with the central axis of the sensor body, and wherein an inner diameter of the through-hole is larger than a part at a reference position X of the sealing member at a part distant from an end on the combustion-chamber-side further than the part at the reference position X of the sealing member, wherein the hole wall surface is a cylindrical shape without threaded grooves between the part at the reference position X of the sealing member and the part distant from the end on the combustion-chamber-side further than the part at the reference position X of the sealing member, and wherein the part at the reference position X of the sealing member seals between the wall surface and the body-side wall surface.

2. An internal combustion engine comprising:

a cylinder head having a through-hole;

a cylinder pressure sensor including a sensor body and a pressure receiving portion, the sensor body including a fixed portion abutting with a head wall surface of the cylinder head on an opposite side to a combustion chamber of the internal combustion engine, the sensor body having a bar shape, the sensor body being placed inside the through-hole, the pressure receiving portion being provided in an end portion of the sensor body on a combustion-chamber-side;

an elastic sealing member that seals between a hole wall surface as a wall surface of the through-hole and a body-side wall surface as a side wall surface of the sensor body; and a clamp configured to cover the fixed portion such that the fixed portion is pressed against the head wall surface by a bolt, wherein the sealing member is placed in a middle of the sensor body in a direction of a central axis of the sensor body, when the sensor body is placed inside the through-hole, the sensor body and the through-hole in a reference state are configured such that at least one combination of values that are taken as D1, D2, D3, and D4 satisfies a dimension relationship of D1<D3×(D2/D4), D1 is a distance in a direction of a central axis of the through-hole from a reference position of the sealing member to a first given position, the first given position being a position of one of the hole wall surface and the body-side wall surface placed on a side closer to the combustion engine than the sealing member, D2 is a distance between the hole wall surface and the body-side wall surface at the first given position where the hole wall surface and the body-side wall surface face each other;

D3 is a distance in the direction of the central axis of the through-hole from the reference position to a second given position, the second given position being a position of one of the hole wall surface and the body-side wall surface placed on a side farther from the combustion engine than the sealing member;

D4 is a distance between the hole wall surface and the body-side wall surface at the second given position where the hole wall surface and the body-side wall surface face each other, the reference state is a state where the central axis of the through-hole is aligned with the central axis of the sensor body, and wherein an inner diameter of the through-hole is larger than a part at a reference position X of the sealing member at a part distant from an end on the combustion-chamber-side further than the part at the reference position X of the sealing member, wherein the hole wall surface is a cylindrical shape without threaded grooves between the part at the reference position X of the sealing member and the part distant from the end on the combustion-chamber-side further than the part at the reference position X of the sealing member, and wherein the part at the reference position X of the sealing member seals between the wall surface and the body-side wall surface.

3. An internal combustion engine comprising:

a cylinder head having a through-hole;

a cylinder pressure sensor including a sensor body and a pressure receiving portion, the sensor body including a fixed portion abutting with a head wall surface of the cylinder head on an opposite side to a combustion chamber of the internal combustion engine, the sensor body having a bar shape, the sensor body being placed inside the through-hole, the pressure receiving portion being provided in an end portion of the sensor body on a combustion-chamber-side;

an elastic sealing member that seals between a hole wall surface as a wall surface of the through-hole and a body-side wall surface as a side wall surface of the sensor body; and a clamp configured to cover the fixed portion such that the fixed portion is pressed against the head wall surface by a bolt, wherein the sealing member is placed in a middle of the sensor body in a direction of a central axis of the sensor body, when the sensor body is placed inside the through-hole, the sensor body and the through-hole in a reference state are configured such that at least one combination of values that are taken as D1, D2, D3, and D4 satisfies a dimension relationship of D1<D3×(D2/D4), D1 is a distance in a direction of a central axis of the through-hole from a reference position of the sealing member to a first given position, the first given position being a position of one of the hole wall surface and the body-side wall surface placed on a side closer to the combustion engine than the sealing member, D2 is a distance between the hole wall surface and the body-side wall surface at the first given position where the hole wall surface and the body-side wall surface face each other;

D3 is a distance in the direction of the central axis of the through-hole from the reference position to a second given position, the second given position being a position of one of the hole wall surface and the body-side wall surface placed on a side farther from the combustion engine than the sealing member;

D4 is a distance between the hole wall surface and the body-side wall surface at the second given position where the hole wall surface and the body-side wall surface face each other, and the reference state is a state where the central axis of the through-hole is aligned with the central axis of the sensor body, wherein an inner diameter of the through-hole located closer to the combustion chamber than the sealing member from a reference position X of the sealing member is larger than that of the through-hole at the reference position X of the sealing member, and wherein a part at the reference position X of the sealing member seals between the wall surface and the body-side wall surface.

4. The internal combustion engine of claim 3, wherein the inner diameter of the through-hole is larger than the part at the reference position X of the sealing member at a part distant from the end on the combustion-chamber-side further than the part at the reference position X of the sealing member.

5. An internal combustion engine comprising:

a cylinder head having a through-hole;

a cylinder pressure sensor including a sensor body and a pressure receiving portion, the sensor body including a fixed portion abutting with a head wall surface of the cylinder head on an opposite side to a combustion chamber of the internal combustion engine, the sensor body having a bar shape, the sensor body being placed inside the through-hole, the pressure receiving portion being provided in an end portion of the sensor body on a combustion-chamber-side;

an elastic sealing member that seals between a hole wall surface as a wall surface of the through-hole and a body-side wall surface as a side wall surface of the sensor body; and a clamp configured to fix the fixed portion such that the fixed portion is pressed against the head wall surface, wherein the elastic sealing member is placed in a middle of the sensor body in a direction of a central axis of the sensor body, when the sensor body is placed inside the through-hole;

the sensor body and the through-hole in a reference state are configured such that at least one combination of values that are taken as D1, D2, D3, and D4 satisfies a dimension relationship of D1<D3×(D2/D4), wherein D1 is a distance in a direction of a central axis of the through-hole from a reference position of the sealing member to a first given position, the first given position being a position of one of the hole wall surface and the body-side wall surface placed on a side closer to the combustion engine than the sealing member;

D2 is a distance between the hole wall surface and the body-side wall surface at the first given position where the hole wall surface and the body-side wall surface face each other;

D3 is a distance in the direction of the central axis of the through-hole from the reference position to a second given position, the second given position being a position of one of the hole wall surface and the body-side wall surface placed on a side farther from the combustion engine than the sealing member; and D4 is a distance between the hole wall surface and the body-side wall surface at the second given position where the hole wall surface and the body-side wall surface face each other, and the reference state is a state where the central axis of the through-hole is aligned with the central axis of the sensor body; and an inner diameter of the through-hole located closer to the combustion chamber than the elastic sealing member from a reference position X of the elastic sealing member is larger than that of the through-hole at the reference position X of the sealing member.

6. The internal combustion engine according to claim 5, wherein the inner diameter of the through-hole is larger than the part at the reference position X of the sealing member at a part distant from the end on the combustion-chamber-side further than the part at the reference position X of the sealing member.

7. The internal combustion engine according to claim 1, wherein an inner diameter of the through-hole located closer to the combustion chamber than the sealing member from a reference position X of the sealing member is larger than that of the through-hole at the reference position X of the sealing member.

8. The internal combustion engine according to claim 2, wherein an inner diameter of the through-hole located closer to the combustion chamber than the sealing member from a reference position X of the sealing member is larger than that of the through-hole at the reference position X of the sealing member.

* * * * *